United States Patent [19]

Price

[11] Patent Number: 4,559,728

[45] Date of Patent: Dec. 24, 1985

[54] DISPLAY MOUNTING DEVICE

[75] Inventor: Edison A. Price, New York, N.Y.

[73] Assignee: Edison Price, Incorporated, New York, N.Y.

[21] Appl. No.: 636,824

[22] Filed: Aug. 1, 1984

[51] Int. Cl.[4] ..... G09F 1/10

[52] U.S. Cl. ..... 40/124.2; 40/618

[58] Field of Search ..... 40/620, 618, 124.2; 248/297.3, 297.2, 225.2; 211/55

[56] References Cited

U.S. PATENT DOCUMENTS

| | | | |
|---|---|---|---|
| 1,465,198 | 8/1923 | Williams | 40/620 |
| 2,738,605 | 3/1956 | Johnson | 40/618 |
| 3,669,035 | 6/1972 | Grossman | 248/225.2 |
| 3,886,676 | 6/1975 | Alfonso | 40/618 |
| 3,963,156 | 6/1976 | Perrin | 248/225.2 |

*Primary Examiner*—Gene Mancene
*Assistant Examiner*—Cary E. Stone
*Attorney, Agent, or Firm*—McAulay, Fields, Fisher, Goldstein & Nissen

[57] ABSTRACT

A display panel provides a secure and aesthetic way to mount pictures and other objects. The panel includes a plurality of resilient, pre-curved slats which are connected to a support board. Each slat has a concave inner surface and a convex outer surface. The slats are connected to the support board in a manner that permits each slat to be moved away from the support board so that a bracket can be inserted between the board and the slat.

18 Claims, 15 Drawing Figures

DISPLAY MOUNTING DEVICE

BACKGROUND OF THE INVENTION

The present invention relates to a display panel and mounting means therefor for mounting pictures and other graphic devices as well as small shelves on which objects can be exhibited.

Various types of display mounting panels having bracket receiving slots or holes are known in the art, but because such slots or holes are visible they call attention to themselves and detract from the effectiveness of the display.

In the present invention, the display mounting panels have no visible open slots or holes. Except on close examination these panels look like plain flat walls, and a primary object of this invention is to provide a display mounting surface that is simple in appearance and aesthetically irreproachable.

Another object of this invention is to provide a secure attachment and an easy and fast mounting and demounting of the pictures and other objects being displayed.

Another object is to assure automatically a precise levelness of the mounted pictures and shelves.

Still another object is to encourage and facilitate orderly arrangements of the matter being displayed. For example, the tops or bottoms of pictures in a row can be made to fall automatically and exactly on a common horizontal line. Moreover pictures that are already mounted on the display panel can be slid to the right or left to achieve any desired vertical alignment, while remaining automatically and precisely on the same horizontal line.

A further feature of the present invention is the provision of a display mounting device in which the support brackets are invisible and, therefore, do not detract from the esthetic appearance of the displayed objects.

BRIEF DESCRIPTION

In this invention, a display mounting panel is provided to which weight bearing brackets or shelves or hooks may be attached. The display mounting panel has a plurality of closed horizontal slots formed by slightly overlapping elongated, resilient, pre-curved slats. The slats are attached to a backing board using an adhesive attaching means associated with each slat so that each slat partially overlaps and presses firmly yet resiliently against the bottom area of the slat above it, from which it may be pried away to create openings of any desired length to receive and securely support weight bearing brackets to which displays or exhibits are affixed.

DESCRIPTION OF THE DRAWINGS

FIG. 7 is a partial side elevational view of the panel of the present invention, with the bar of FIG. 6 in place;

DESCRIPTION OF THE PREFERRED EMBODIMENT

Figure 1:
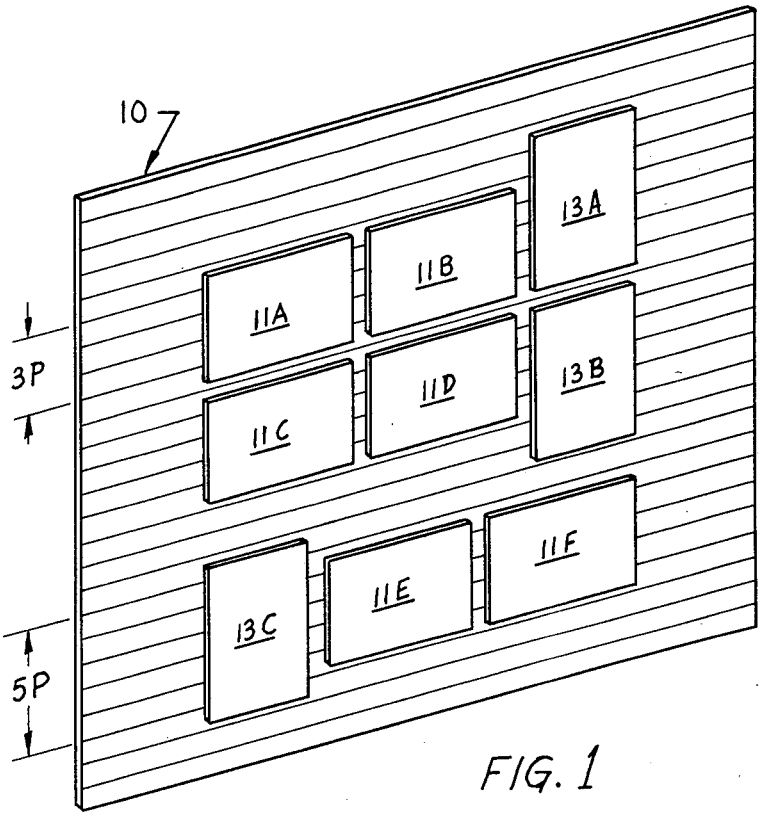
FIG. 1 is a perspective view of the display mounting panel of the present invention showing objects being displayed thereon.
Figure 5:
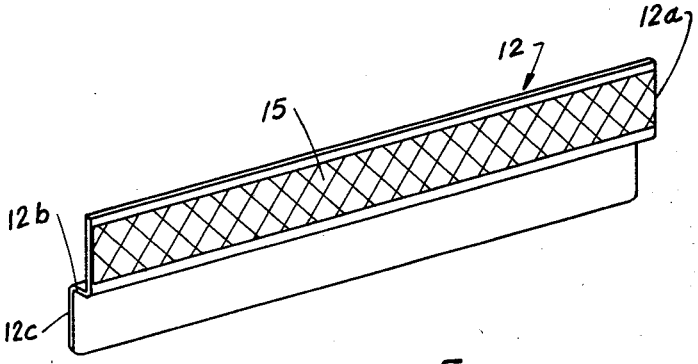
FIG. 5 is a perspective view of the bracket shown in FIGS. 4A and 4B, to enlarged scale, as seen looking from the rear of the bracket.

A display mounting device constructed according to the present invention includes a panel designated generally by the reference numeral 10 in the FIGS. Panel 10 is designed to hold a plurality of weight bearing brackets of which bracket 12, (FIG. 5) is illustrative. Objects such as photographs 11A–11F and 13A–13C and other similar items can be securely mounted by such brackets in an orderly and aesthetically pleasing manner on panel 10. Moreover, as noted in greater detail below, the device permits the easy vertical and horizontal alignment of objects, as shown in FIG. 1. Thus, the upper edges of horizontally oriented objects 11A and 11B are aligned and the lower edges are aligned with vertically oriented object 13A. Similar comments apply to the upper edges of objects 11C and 11D with the upper edge of object 13B. The vertical edges of 11A and 11C may be aligned with the vertical edge of object 13C, and 13C, 11E and 11F are mounted with a common horizontal center line. Other variations may also be made as desired.

The panel 10 comprises a support board or plate 18 and a plurality of resilient, pre-curved slats 14 connected thereto. The slats 14 have a concave inner surface facing the board 18 and a convex outer surface.

In a preferred embodiment the slats 14 are formed from 7075 aluminum having a 67,000 pound yield strength. Each slat is about 0.012 inches in thickness and between 1 through 4 inches in width, a 2 inch width being the most desirable.

Respective attaching means 16 are provided to connect each slat to the support or backing board 18. Each attaching means is associated with a slat 14. However, if desired, the slats 14 can be attached directly to a wall or other appropriate and substantially flat surface. The slats 14 are attached using attaching means 16 which in a preferred embodiment is a double-backed adhesive tape which may be 0.002–0.005 inches thick. In other words, the thickness of the tape is approximately 20–40% of the thickness of the slat 14. Preferably the tape 16 is positioned on its associated slat such that the bottom edge thereof is substantially aligned with the bottom edge of the associated slat.

Figure 2:
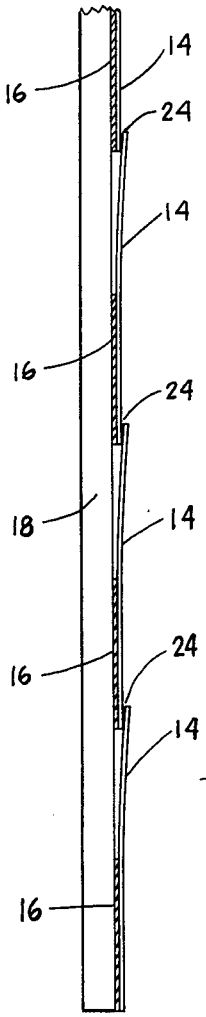
Figure 3:
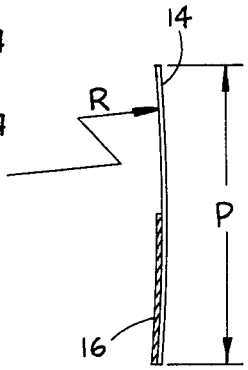
FIG. 3 is an end view of one slat of the panel of the present invention.

As best shown in FIG. 2, the slats 14 are positioned on the backing board such that each slat partially overlaps the slat above it to thus form a plurality of closed bracket-receiving slots 24. That is the radius of curvature causes the top edge of the slat to press against the slat immediately above and exert a slight bias to form such closed slot. Preferably, for a two inch slat, each slat overlaps the slat above it by about ⅛ of an inch.

If the top of one slat stops short of the bottom of the next higher slat then both slat edges show, and the slats become more visible and their appearance more obtrusive. Because the edges of the slats are never perfectly straight it is not possible to have the top edge of one slat exactly above the bottom edge of the next higher slat and touching it along the entire length. Even if this could be achieved, it would be undesirable because it would be almost impossible to insert a prying device between the edges to separate the slats and insert a supporting bracket. The ⅛ inch overlap is a practical compromise that assures that the lower bracket will overlap the upper despite the lack of straightness that may occur with slats up to about 8′ long.

However, as an alternative, the slats may overlap by 50%. In this case, the entire panel may be coated with an adhesive and the slats attached thereto. The bottom half of each slat will prevent the upper half of the next lower slat from contacting the adhesive. This has the advantage of increasing the ease of manufacture. It also permits a finer degree of vertical adjustment of objects on the panel because the pitch P (distance between slots 24) would be approximately halved (i.e., would become one inch for a two inch slat). Disadvantageously, this alternate would double the number of slats required and consequently increase the cost and weight of the panel substantially.

Bracket 12 (FIG. 5), which may be used to mount objects such as 11A or 13B to the panel, is generally "Z" shaped and is adapted for connection directly to the back of a picture or a photograph or the like. Bracket 12 includes a first vertical leg **12*a* which is connectable to the rear surface of the object, a horizontal central portion 12*b*, and a vertically depending second leg 12*c*, which is generally parallel to and off-set from first leg 12*a*. A double-backed adhesive tape 15 on the rear surface of leg 12*a*** connects the bracket to the object.

In practice, the brackets may be fabricated from the same thin but strong material as the slats to avoid unsightly bulges on the slats. Similarly, the tape 15 may be the same as the tape 16.

Figure 4B:
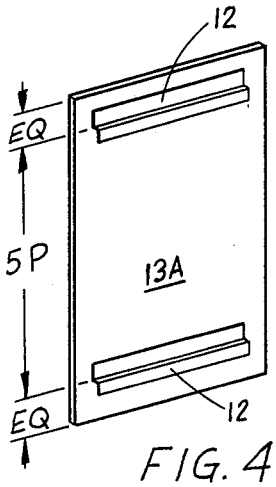
FIG. 4B is a perspective view of an object similar to FIG. 4A, illustrating the connection of brackets to an object having a greater vertical dimension.
Figure 4A:
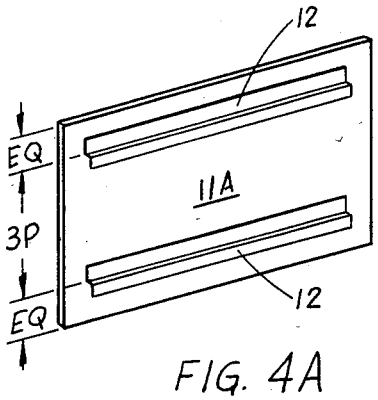
FIG. 4A is a perspective view of an object mountable on the panel, illustrating mounting brackets connected thereto.

FIGS. 4A and 4B illustrate how the brackets 12 may be located on the rear surface of an object depending on the height of the object. Thus, for an object 13A having a substantial height, brackets 12 may be positioned apart a distance of 5P (where P corresponds to the distance between slots 24) measured from central portion **12*b*** of the brackets. Each bracket is located an equal distance from the respective top and bottom edge.

For a smaller object, such as 11A in FIG. 4, the brackets may be spaced apart a distance of 3P, and also equally located from each edge. The brackets 12 terminate inwardly of the side edges of the objects for the reasons noted below in connection with the description of the shelf shown in FIG. 14.

Figure 7:
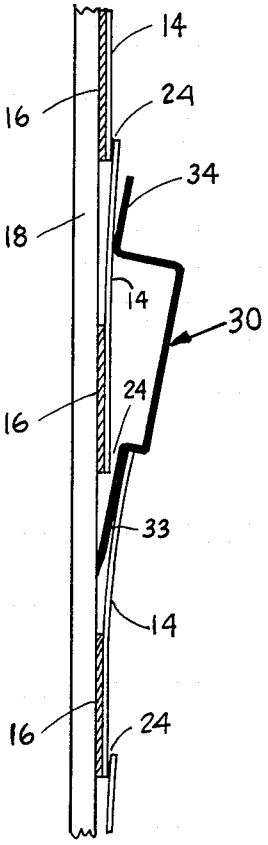
FIG. 7 is a side elevational view thereof, showing the overlapping slats of the panel of FIG. 1.
Figure 6:
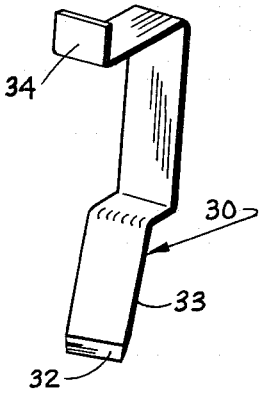
FIG. 6 is a perspective view of a pry bar for opening the closed slots on the panel.

The slats 14 must be pried away from the backing board to open the slot 24 for the insertion of a bracket. That is, in practice the slats have a radius of curvature of approximately 8P. When the curved slat 14 is affixed by adhesive 16 to the backing board 18 this curve tends to straighten out or slightly reverse, and this leaves a residual bias in slat 14 that urges its top edge tightly against the lower area of the next higher slat. Therefore, the slot 24 must be pried open to insert leg **12*c* therein and the opening must be maintained while the bracket is being inserted. FIG. 7 shows prying bar 30 in position so that the user can easily insert the depending leg of the bracket. As shown in FIG. 6, one embodiment of an appropriate pry bar or opener 30 has a sharp pointed blade tip 32 at the end of a leg 33 to aid in insertion through closed slot 24 and behind the slat. A bent upper end 34, which extends forwardly, beyond the plane of the leg 33 is adapted to bear against the next higher slat 14** and bend the lower slat away to provide a space or opening between the two slats.

In operation, the blade 32 of the bar 30 is inserted into a selected slot 24 and pushed downwardly. The taper of the leg 33 causes the associated slat to bend outwardly, away from the board 18. An offset at the top of leg 33 limits the distance the pry bar can be inserted and so limits the width of the opening to the most favorable amount. When the bar is released, the end 34 bears against the panel to maintain the bent slat away from the board. The bracket leg **12*c* may then be inserted into the thus opened slot 24. Simultaneously, a second bar may be used to open the slot 24** associated with the second bracket on the object so both brackets may be inserted at the same time.

After the brackets are installed the bars are removed. The resiliency of the slats urges them toward their original positions so that they bear against the bracket legs **12*c*** to maintain the attached objects in the desired position.

The slots 24 extend longitudinally across the entire backing board. Thus the objects displayed on the display mounting device can be easily shifted longitudinally along a precise horizontal line. As is obvious from the aforedescribed construction, the brackets are easily placed in and removed from the slots to thereby permit the items displayed on the board to be easily changed. For large objects additional appropriately spaced brackets may be used.

FIGS. 9–14 illustrate modified embodiments of brackets that may be used to mount objects to the panel 10. For example, the object 60 (FIG. 8) may be mounted on the panel 10 by the brackets 62 and 64 respectively shown in FIGS. 10 and 11. The bracket 62 includes ears 66 and a forwardly and inwardly extending clip portion 68. The side edge of the object is received in the clip portion 68 and the ear 66 is inserted in the appropriate slot 24 in the manner noted above. Either one of the ears 66 may be used depending on whether the bracket 62 engages either the right- or left-hand edge of the object.

The bracket 64 supports the bottom edge of the object and includes a depending leg 70 adapted to be received in the slot 24 directly below the object. Forwardly off-set from leg 70 is an upstanding portion 72 that engages the front of the object to maintain the object against the panel with the bottom edge of the panel resting on the horizontal connecting portion 74.

Figure 8:
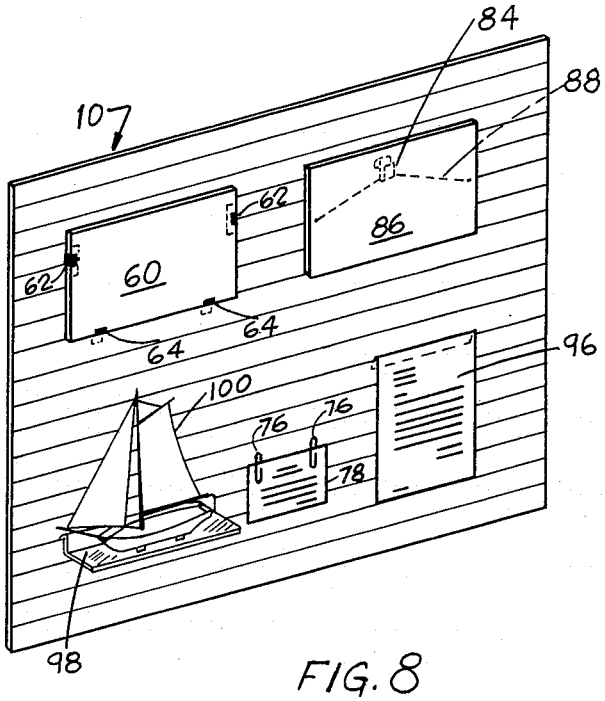
FIG. 8 is a perspective view of a panel similar to FIG. 1, showing objects mounted thereon by different mounting devices.
Figure 9:
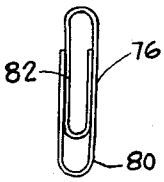
FIG. 9 is a front elevational view of a clip used to mount objects to the panel.
Figure 10:
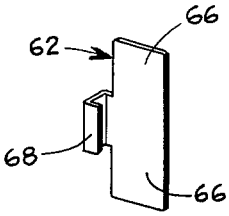
FIG. 10 is a perspective view of a modified embodiment of a mounting bracket adapted to engage the side edges of an object.
Figure 11:
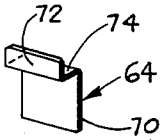
FIG. 11 is a perspective view of a further modified embodiment of a mounting bracket adapted to engage the bottom edge of an object.
Figure 12:
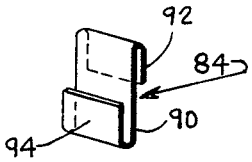
FIG. 12 is a perspective view of another modified embodiment of a mounting bracket used to support a hanging object.

A conventional paper clip 76 (FIG. 9) may be used to support light objects such as a card 78 (FIG. 8). Thus, the longer leg 80 of the clip is inserted in a slot 24 while the shorter leg 82 overlies the card 78 and clips the card to the slat 14.

A simple horizontal return fold close to and parallel to the top edge of a sheet of paper as shown in 96 (FIG. 8) permits the folded portion of the sheet to be inserted into a slot opening 24 so that the paper is supported without any mounting brackets being required.

Bracket 84 (FIG. 12) may be used to support a hanging object 86 provided with a support wire or string 88 on the panel. Bracket 84 includes a central vertical portion 90, a rear member 92 spaced from the portion 90 and depending from the top edge, and a forward upstanding member 94 spaced from portion 90 and connected to the bottom edge thereof. Member 92 is inserted into a slot 24 and wire 88 is placed between portion 90 and member 94 to mount object 86 on the panel. Obviously, bracket 90 may be turned end-for-end so that member 94 becomes the rear member.

Figure 13:
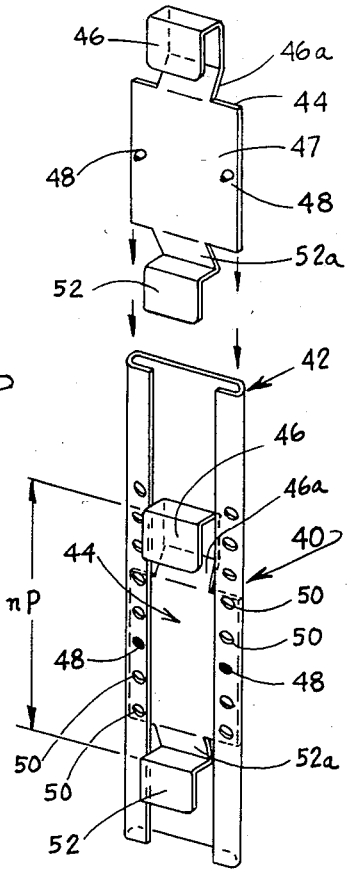
FIG. 13 is a perspective view of another modified embodiment of a mounting bracket adapted to permit a fine vertical adjustment of an object mounted on the panel.

In some instances it may be desirable to provide some latitude in the vertical placement of an object 96 to be displayed, particularly when one uses a two inch pitch. Accordingly, FIG. 13 illustrates an adjustable bracket 40 that may be used. The bracket 40 comprises a channel-shaped member 42, the back of which is adapted to be connected by double-backed tape or the like to the object to be displayed. Received within the channel is a mounting member 44 made of a resiliant material, having a forwardly extending upper hook section 46, a central plate section 47 extending between the channels and having spaced projections 48 adapted to be received in respective ones of a plurality of vertically spaced apertures 50 in the channels, and a lower hook section 52. The upper and lower hook sections are separated by some multiple of the pitch. The lower portion 46*a* of the section 46 and the upper portion 52*a* of the section 52 extend rearwardly against the back portion of member 42 to bias the plate section 44 against the channels to firmly seat the projections 48 in an associated aperture.

In operation, the bracket 40 with the article connected thereto is mounted on the display device in a manner similar to that associated with bracket 12. That is, slats are pryed away from the support board 18 and the hook portions 46 and 52 are inserted in the openings so formed. It it is then desired to adjust the article on the board within the limits of the bracket 42, the article is pushed rearwardly to reduce the bias between the member 44 and the channels and the article may be moved upwardly or downwardly, as the case may be. The article is then released to permit the projections 48 to firmly seat in the new set of apertures 50. Alternatively, the bracket may be adjusted prior to mounting the same on the display device. In a preferred embodiment, the apertures 50 are spaced over a distance equal to the pitch P of the slats to provide a continuous range of adjustment within each increment of P across the board.

Figure 14:
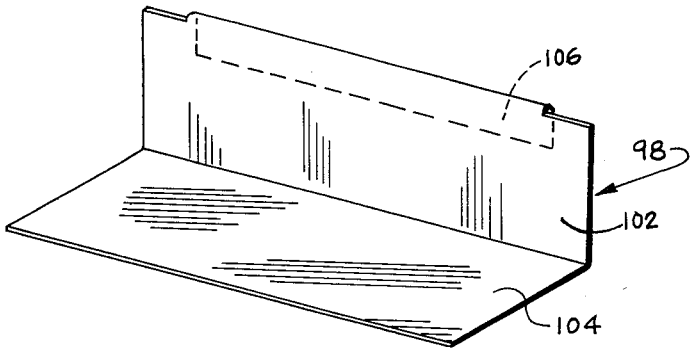
FIG. 14 is a perspective view of a support shelf for supporting objects on said panel.

FIG. 14 illustrates a shelf 98 that may be mounted on the panel 10 to display a three-dimensional object such as a model boat 100. The shelf 98 comprises vertical member 102 and horizontal forwardly extending member 104 connected to the bottom edge thereof. Connected to the upper edge of member 102 and spaced inwardly from the side edges thereof is a rearwardly spaced depending leg 106 adapted to be received within a slot 24 to mount the shelf on the panel. As noted, the leg 106, as is the brackets 12, is spaced inwardly from the side edges to eliminate any unsightly bulges at the side edges of the shelf or object in the case of bracket 12.

While the invention has been particularly shown and described with reference to the preferred embodiments thereof, it will be understood by those schooled in the art that various changes in form and detail may be incorporated therein without departing from the spirit and scope of the invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed is:

1. A display mounting device comprising:

a planar support board;

at least one resilient, pre-curved slat having a concave inner surface and a convex outer surface;

longitudinally extending attaching means connected to the inner surface of said slat and spaced downwardly from the top edge thereof to connect the slat to the support board so that the upper and lower portions of said slat abut said board, whereby the top portion of said slat may be moved away from said board to permit the insertion of a bracket therebetween.

2. A display device as in claim 1, comprising a plurality of resilient, pre-curved slats each having a concave inner surface and a convex outer surface;

respective attaching means for each of said slats connected to the inner surface of the associated slat and spaced downwardly from the top edge thereof;

each one of said plurality of slats being connected to said board so that the top portion of one slat overlaps the bottom portion of the slat immediately above it to form a plurality of spaced closed slots.

3. The display mounting device of claim 2, wherein each slat has a radius of curvature of about eight times the width of the salt.

4. The display mounting device of claim 2, wherein each slat is between about 1 inch and about 4 inches in width.

5. The display mounting device of claim 4, wherein each slat is 2 inches in width.

6. The display mounting device of claim 2, wherein each slat is fabricated from 7075 aluminum having a 67,000 pound yield strength.

7. The display mounting device of claim 2, wherein each slat is about 0.012 inches thick.

8. The display mounting device of claim 2, wherein said attaching means is double-backed adhesive tape.

9. The display mounting device of claim 2, wherein each slat overlaps the slat above it by approximately $\frac{1}{8}$ of an inch.

10. The display device as in claim 2, and means for moving the top portion of a selected slat away from said board, said means comprising a bar having a vertical leg having an inwardly bent portion adjacent the bottom for insertion between a slat and said board, and a horizontal arm extending rearwardly to engage said board.

11. A display device as in claim 2, and a bracket in combination therewith, said bracket being Z-shaped in cross section, and connecting means on one leg of said Z-shaped bracket for connecting said bracket to an object to be supported, said bracket being sized to terminate inwardly of the side edges of the object.

12. A display device as in claim 2 and an adjustable mounting bracket in combination therewith, said bracket comprising a member having channels which slidably receive a plate therein, a hook on said plate receivable between any two of said plurality of slats, and connecting means between said member and said plate for connecting said plate to said channels in a preselected one of a plurality of different positions.

13. A display device as in claim 12, wherein said adjustable mounting bracket has a length such that said bracket terminates inwardly of the side edges of an object being mounted on said device.

14. A display device as in claim 2, and a side mounting bracket in combination therewith, said side mounting bracket comprising two opposed ear segments and a forwardly extending clip segment, the side edge of an object to be mounted being receivable in said clip segment and either one of said ear segments being insertable between said board and one of said plurality of slats.

15. A display device as in claim 2, and a bottom mounting bracket in combination therewith, said bottom mounting bracket comprising a depending leg receivable between said board and one of said plurality of slats, an upstanding portion forwardly off-set from said depending leg for engaging the front of an object to be mounted, and a connecting portion connecting said depending leg and said upstanding portion.

16. A display device as in claim 2, and a bracket usable with hanging objects in combination therewith, said bracket comprising a central vertical segment, a rear segment spaced from said central segment and connected to the top edge thereof, said rear segment receivable between any two of said plurality of slats, and a forward upstanding member spaced from said central segment and connected to the bottom edge thereof, whereby a support wire connected to an object to be hung is placeable between said central segment and said forward upstanding member.

17. A display device as in claim 2, and a shelf in combination therewith, said shelf comprising a vertical member and a horizontal member, said shelf attachable to said device by a connecting leg attached to the upper edge of said vertical member and spaced inwardly from the side edges thereof, said connecting leg depending rearwardly from said vertical member and being receivable between said board and one of said plurality of slats.

18. A method of displaying pictures comprising the steps of:

providing a display device having a plurality of slats formed by partially overlapping resilient, precurved elongated slats, said slats being attached to a backing member;

attaching a generally Z-shaped elongated bracket to the rear surface of an item to be displayed;

prying at least one of said slats outwardly away from said backing member to create a space therebetween;

inserting a portion of said Z-shaped bracket into said space between said backing member and said slat while said slat is in said pried away position; and permitting said slat to return to its up-pried position such that it securely holds said bracket and its attached display device.

* * * * *